US005640889A

United States Patent [19]

Anderson

[11] Patent Number: 5,640,889

[45] Date of Patent: Jun. 24, 1997

[54] LUG NUT REMOVAL AND STORAGE DEVICE

[76] Inventor: George Anderson, 19878 Christie Way, Sonora, Calif. 95370

[21] Appl. No.: 558,637

[22] Filed: Nov. 13, 1995

[51] Int. Cl.[6] ..... B25B 13/02

[52] U.S. Cl. ..... 81/125; 81/124.1; 279/82

[58] Field of Search ..... 81/124.1, 125, 81/438; 279/76, 80, 82

[56] References Cited

U.S. PATENT DOCUMENTS

| | | | |
|---|---|---|---|
| 2,896,489 | 7/1959 | Madsen | 81/124.1 |
| 2,993,397 | 7/1961 | Albertson et al. | 81/125 |
| 3,005,367 | 10/1961 | Vose | 81/125 |
| 4,202,557 | 5/1980 | Haussmann et al. | 279/82 X |

*Primary Examiner*—James G. Smith

*Attorney, Agent, or Firm*—Goldstein & Associates

[57] ABSTRACT

A lug nut removal and storage system, for removing lug nuts from lug bolts, comprising a tube. The tube has a tube exterior, a proximal end, a distal end, and a proximal distal axis. A channel extends into the distal end wherein the lug nuts are stored. A plurality of ball bearings are disposed around the channel near the distal end. The ball bearings in ball bearing bores transverse to the channel, the ball bearings moving in the ball bearing bores to narrow and widen the channel. A spring clip selectively restricts the outward movement of the ball bearings, so that the ball bearings will maintain the lug nuts in the channel, and releases the ball bearings so that the ball bearings will widen the channel sufficient to release the lug nuts from the channel. A main spring extends in the channel from the proximal end toward the distal end, the main spring biasing the lug nuts against the ball bearings.

3 Claims, 3 Drawing Sheets

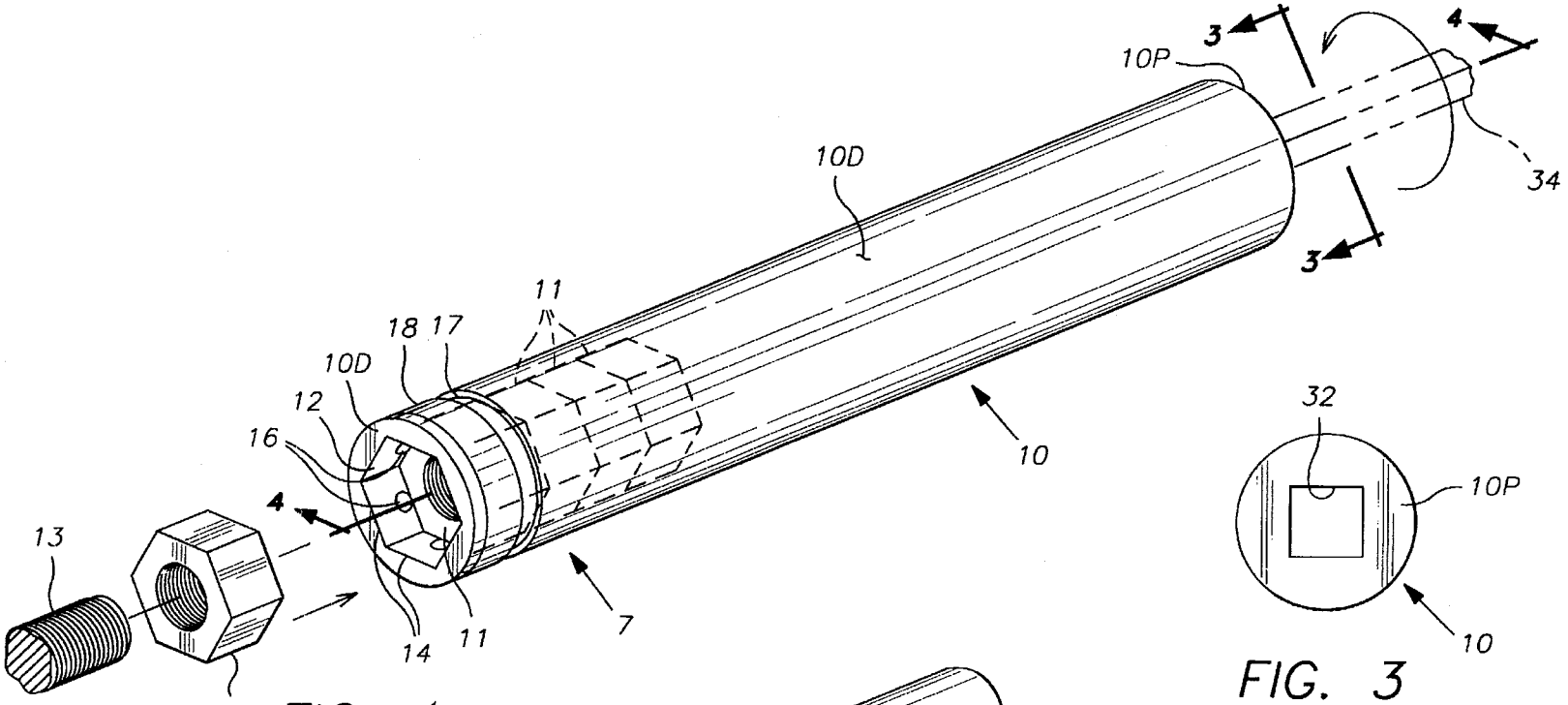
FIG. 1
FIG. 3
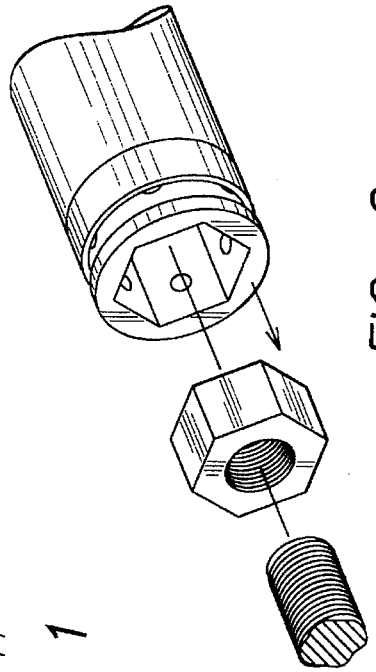
FIG. 2

LUG NUT REMOVAL AND STORAGE DEVICE

BACKGROUND OF THE INVENTION

The invention relates to a lug nut removal and storage device. More particularly, the invention relates to a system that will easily remove the lug nuts from an automobile wheel, hold the lug nuts during the tire changing operation, and then release the lug nuts as they are being restored onto the lug bolts.

Changing a tire is a dreaded task. The need to change a tire usually arises unexpectedly and then is extremely inconvenient. Typically a flat tire will occur when the driver is on the way somewhere, perhaps already late, and perhaps dressed in nice clothing.

During tire changing, the lug nuts are first loosened, the tire is raised off the ground, and the lug nuts are then removed. As the lug nuts are removed, there is no suitable storage location for them. It is undesirable to place them on the body of the car: they can easily scratch the paint, or roll off the car and become lost. It is also undesirable to place them inside the car. Since the lug nuts usually become caked with road grease, brake dust, and corrosion, they can easily soil the interior. Often, people place the lug nuts on a nearby sidewalk or curb. However, they can easily roll away and become lost—especially in the dark.

If one lug nut is lost, the wheel can probably be restored onto the car, less one lug nut, with only minimal danger. However, if more than one lug nut is lost, one can not effectively secure the wheel, and thus should not attempt to drive the car under such conditions. The car would need to be towed until a suitable lug nut is located.

Others have proposed solutions that attempt to streamline the tire changing operation. The majority of these solutions have focused on improving the jack to more easily lift the car. Others have sought to improve the jack handle to make it easier to loosen the lug nuts. To date no one has proposed an effective solution to ease handling of the lug nuts.

While these units may be suitable for the particular purpose employed, or for general use, they would not be as suitable for the purposes of the present invention as disclosed hereafter.

SUMMARY OF THE INVENTION

It is an object of the invention to produce a lug nut removal and storage system that may be used to loosen a lug nut, store the lug nut as it is removed from a lug bolt, and then release the lug nut following the tire changing operation.

It is another object of the invention to produce a lug nut removal and storage system that can store several lug nuts during the tire changing operation and then release them individually when needed.

It is a further object of the invention that travel into and out of the device is limited by a plurality of ball bearings disposed in the channel into and out of the device. The ball bearings are restricted by a spring clip, which selectively tensions the ball bearings against the channel. The spring clip may be released so that the ball bearings allow the lug nuts to exit the channel.

It is a still further object of the invention that the spring clip flexes to allow the lug nuts to enter the channel, but will exert sufficient force on the ball bearings to keep the lug nuts inside the channel until released.

The invention is a lug nut removal and storage system, for removing lug nuts from lug bolts, comprising a tube. The tube has a tube exterior, a proximal end, a distal end, and a proximal distal axis. A channel extends into the distal end wherein the lug nuts are stored. A plurality of ball bearings are disposed around the channel near the distal end. The ball bearings in ball bearing bores transverse to the channel, the ball bearings moving in the ball bearing bores to narrow and widen the channel. A spring clip selectively restricts the outward movement of the ball bearings, so that the ball bearings will maintain the lug nuts in the channel, and releases the ball bearings so that the ball bearings will widen the channel sufficient to release the lug nuts from the channel. A main spring extends in the channel from the proximal end toward the distal end, the main spring biasing the lug nuts against the ball bearings.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is an exploded perspective view of the invention, illustrating how it is used to remove a lug nut from a lug bolt.

FIG. 2 is a diagrammatic perspective view of the invention, illustrating how it is used to restore the lug nut onto the lug bolt.

FIG. 3 is a top plan view of the invention, taken in the direction of line 3—3 in FIG. 1.

DETAILED DESCRIPTION OF THE PREFERRED EMBODIMENTS

Figure 4:
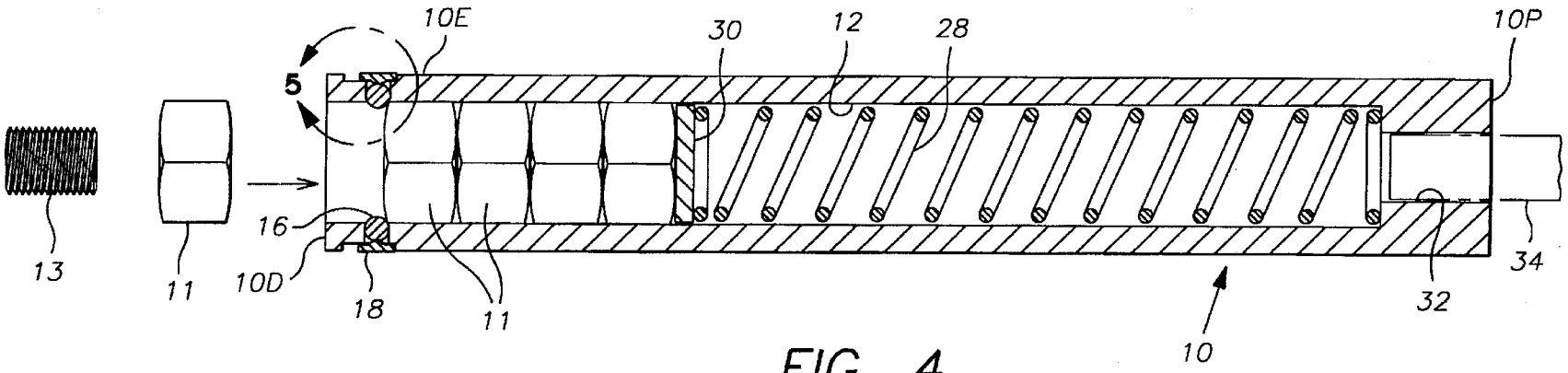
FIG. 4 is a cross sectional view of the invention, taken in the direction of cutting plane line 4—4 in FIG. 1, illustrating the lug nut removal and storage operation.

FIG. 1 illustrates a lug nut removal and storage device, for removing a lug nut 11 from a lug bolt 13. The lug bolt 13 is present on an automobile wheel hub, typically in groups of four or five lug bolts 13. The lug bolts 13 extend through a wheel which bears a tire, and secure the wheel to the wheel hub with the lug nuts 11. The lug nuts 11 are typically either square, pentagonal, hexagonal, or octagonal.

The lug nut removal device comprises a tube 10. The tube is cylindrical in shape, having a tube exterior 10E, a proximal end 10P and a distal end 10D. The tube 10 thus has a proximal-distal axis extending between the proximal 10P and distal 10D ends. The tube exterior 10E has a tube exterior diameter, which is the same at both the proximal end 10P and distal end 10D, and virtually everywhere in between. The tube 10 has a channel 12 which extends into the distal end 10D. The channel 12 has a plurality of interior sides 14, and is shaped and sized to accommodate the lug nuts 11, whose removal and storage is intended. Thus, the channel 12 is pentagonal, hexagonal, or octagonal, having five, six, or eight interior sides 14 respectively. Illustrated in the drawing figures, hexagonal lug nuts 11 are shown, therefore the channel 12 is hexagonal, and has six interior sides 14. As illustrated in phantom in FIG. 1, several lug nuts 11 are already stored inside the channel 12.

Figure 7:
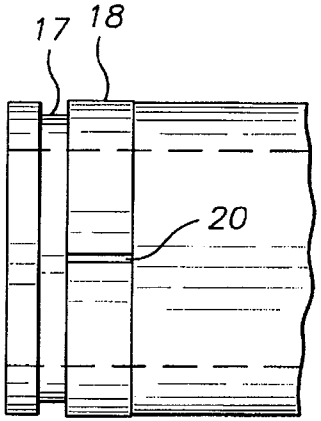
FIG. 7 is an diagrammatic perspective view, taken in the direction of arrow 7 in FIG. 1, illustrating the spring clip.

Ball bearings 16 are disposed on the interior sides 14 of the channel, near the distal end 10D of the tube 10. Preferably one ball bearing 16 is present at the middle of each interior side 14—in other words equidistant from adjacent interior sides 14. The tube 10 has an indentation 17 that is concentric with the tube exterior 10E, but is slightly less in diameter. A spring clip 18 is mounted in the indentation 17, holding the ball bearings 16 in place. Referring to FIG. 7, the spring clip 18 comprises a metal band which encircles the tube in the indentation 17, but does not form a closed loop, but instead forms a gap 20. When the ball bearings 16 exert pressure against the spring clip 18, the spring clip 18 may allow the ball bearings 16 to expand outward, away from the channel 12, to let the lug nuts 11 slide into the channel beyond the ball bearings. The spring clip 18 allows the ball bearings 16 to expand outward by flexing, and varying the size of the gap 20, thus loosening the grip of the spring clip 18 around the ball bearings 16. The gap 20 shrinks when the ball bearings flex the spring clip 18, and then expands as the ball bearings are pushed back toward the channel 12.

Figure 5:
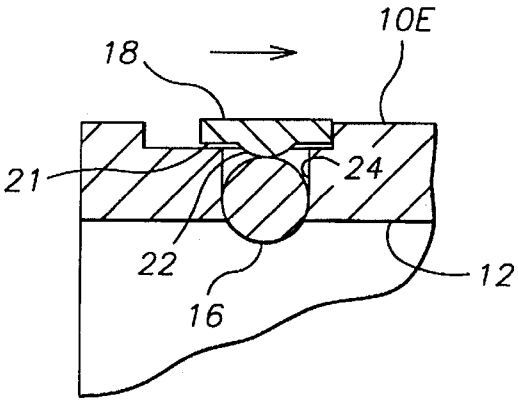
FIG. 5 is an enlarged cross sectional view of the invention, taken in the direction of arrow 5, in FIG. 4.

FIG. 5 details the mounting of the ball bearings 16, which are each contained within a ball bearing bore 24. The ball bearing bore extend transverse to the proximal-distal axis of the tube, from the exterior 10E toward the channel 12. The movement of each ball bearing 16 is bounded by the spring clip 18, and a ball bearing seat 26 (see FIG. 6), the ball bearing seat 26 located at the junction of each ball bearing bore 24 and the channel 12. Thus, the ball bearing seat 26 prevents the ball bearings from falling into the channel 12, and the spring clip 18 prevents the ball bearings from leaving the ball bearing bores 24 at the exterior 10E. The spring clip has a band 21 and a protrusion 22 extending from the band 21, fully around the spring clip, protruding toward the channel 12.

FIG. 5 also details the spring clip 18 in a loading position, in which the lug nuts 11 are loaded into the channel 12 and held therein. The protrusion 22 is centered on the spring clip 18. When in the loading position, the protrusion 22 is positioned directly over the ball bearings 16, so that the protrusion 22 is in direct contact with the ball bearings 16, pushing the ball bearing into the channel, preventing passage of the lug nuts. In fact, the distance that the protrusion 22 protrudes from the spring clip is equal to the distance that the ball bearing protrudes into the channel. Thus, in the loading position, the ball bearings deter the lug nuts from easily passing into or out of the channel past the ball bearings 16.

Figure 6:
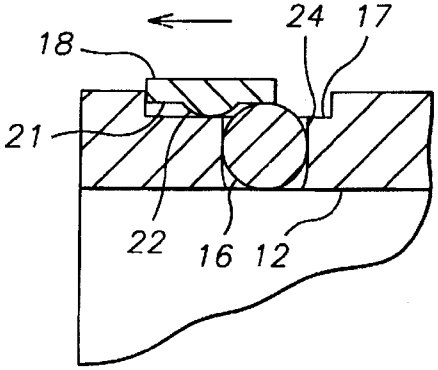
FIG. 6 is an enlarged cross sectional view, taken in the direction of arrow 6 in FIG. 4A.

As illustrated in FIG. 6, the spring clip 18 is capable of sliding in the proximal-distal direction in the indentation 17, from the loading position, to a release position. In the release position, the protrusions 22 are not positioned directly over the ball bearings 16. Thus, the ball bearing is allowed to move outward toward the tube exterior 10E, away from the channel, until its movement is prevented by the band 21 of the spring clip 18. The band 21 will in fact prevent the ball bearings from falling out of the ball bearing bores 24, but will allow sufficient play in the movement of the ball bearings, so that they will allow the lug nuts to be released from the channel 12.

FIG. 4 is a cross sectional view, in which the loading and storage action is illustrated. As illustrated, several lug nuts 11 have already been loaded into the channel 12 beyond the ball bearings 16. A main spring 28 extends through the channel from nearly the proximal end 10P, toward the distal end 10D. At the distal end of the main spring 28, an end plate 30 extends across the channel 12. The main spring 28 biases the end plate against the lug nuts 11. The lug nuts 11 are in turn biased against the ball bearings 16. Thus, as the lug nuts 11 are loaded, the main spring 28 is compressed, and the lug nuts are kept from moving significantly within the channel 12.

Referring to FIG. 3, a socket 32 extends into the proximal end 10P of the tube 10. Referring back to FIG. 4, the socket 32 is engaged with a lever shaft 34. The lever shaft 34 is operated by the user to produce rotational moments around the proximal distal axis of the tube 10. As illustrated in FIG. 1, the channel 12 engages the lug nut 11 on the lug bolt. The tube 10 is rotated by the lever shaft 34 to loosen the lug nut 11 from the lug bolt 13.

Referring to FIG. 4, as the lug nut 11 is loosened, pressure is exerted by the lever shaft 34 against the lug bolt 13, thus urging the lug hut further into the channel 12. The lug nut 11 encounters the ball bearings 16, and exerts pressure against them. The pressure on the ball bearings 16 causes the spring clip 18 to flex, allowing the ball bearings to move toward the tube exterior 10E, thus widening the channel 12, and allowing the lug nuts 11 to pass further into the channel 12. After each lug nut 11 passes into the channel beyond the ball bearings, the pressure on the ball bearings 16 is relieved, allowing the spring clip 18 to flex back, thus causing the ball bearings 16 to once again narrow the channel 12. The main spring 28 and spring clip 18 are selected so that when the channel 12 is loaded with a full set of lug nuts 11, and the spring clip 18 is in the loading position, the spring force of the main spring 28 will be insufficient to overcome the spring force of the spring clip 18. Thus, the lug nuts 11 will be held securely in the channel 12. But, the spring clip 18 should also be selected so that manual pressure upon the lever shaft 34 by the user will cause the ball bearings to widen the channel sufficient to allow the lug nut 11 to pass and load into the channel 12.

Figure 4A:
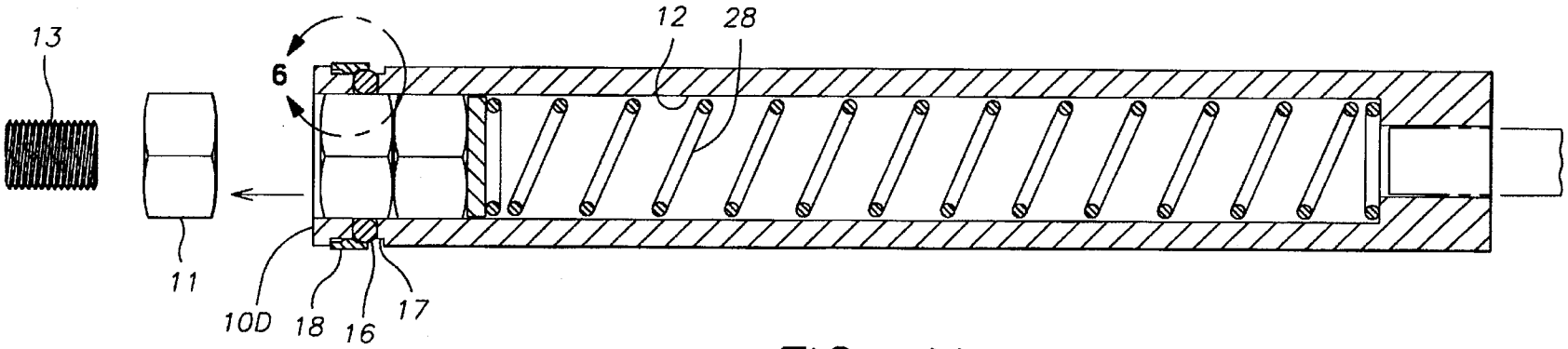
FIG. 4A is a cross sectional view of the invention, similar to FIG. 4A, except during the lug nut releasing operation.

FIG. 4A illustrates how the lug nuts are released. The spring clip 18 is moved in the indentation 17 from the loading position, as shown in FIG. 4, to the release position. In the release position, since the protrusion 22 is moved off-center from the ball bearings 16, the main spring 28 pushes the ball bearings 16 outward, widening the channel 12 and allowing the lugs nuts to be pushed out of the channel 12 at the distal end 10D by the main spring.

Further illustrated in FIG. 4A, the released lug nuts 11 are threaded onto the lug bolts 13, and are tightened using the channel 12 as a wrench. The channel is torqued by the lever handle 34.

In conclusion, herein is presented a system for removing lug nuts at the commencement of a tire changing operation, storing the lug nuts during the tire changing, and releasing the lug nuts at the finish of the tire changing operation.

What is claimed is:

1. A lug nut removal and storage system, for removing lug nuts from lug bolts, and storing and releasing the lug nuts, comprising:

a tube, the tube having a tube exterior, a proximal end, a distal end, and a proximal distal axis, the tube having a channel extending into the distal end, the tube further having an indentation near the distal end;

a plurality of ball bearings, each ball bearing in a ball bearing bore extending transverse to the proximal-distal axis, the ball bearings capable of movement toward the channel to narrow the channel to hold lug nuts in the channel, and away from the channel to widen the channel to allow lug nuts to enter the channel for storage;

a spring clip, the spring clip biasing the ball bearings toward the channel, the spring clip does not form a closed loop, the spring clip has a gap which varies in size as the spring clip flexes, the spring clip releasable to release the ball bearings so that the ball bearings will widen the channel and allow the lug nuts to exit the channel, the spring clip slidably mounted in the indentation for allowing the spring clip to slide between a loading position and a release position, the spring clip comprising a band and a protrusion extending toward the channel, when in the loading position the protrusion is directly above the ball bearings and restricts movement of the ball bearings toward the tube exterior; and a main spring, extending in the channel from the proximal end toward the distal end for exerting pressure against lug nuts contained in the channel against the ball bearings, to minimize movement of lug nuts stored in the channel.

2. The lug nut removal and storage system as recited in claim 1, wherein the tube further comprises a socket in the proximal end, the socket accommodating a lever handle, for torquing the tube about the proximal-distal axis.

3. The lug nut removal and storage system as recited in claim 1, wherein the channel is sized and shaped to accommodate the lug nuts with a snug fit and is of a cross-sectional shape selected from pentagonal, hexagonal, or octagonal.

* * * * *